US009559431B2

(12) United States Patent
Tong et al.

(10) Patent No.: US 9,559,431 B2
(45) Date of Patent: Jan. 31, 2017

(54) ANTENNA CONFIGURATION FOR USE IN A MOBILE COMMUNICATION DEVICE

(71) Applicant: UCL Business PLC, London (GB)

(72) Inventors: Kin-Fai Tong, London (GB); Hong-Jun Tang, Jiangsu (CN)

(73) Assignee: UCL BUSINESS PLC, London (GB)

( * ) Notice: Subject to any disclaimer, the term of this patent is extended or adjusted under 35 U.S.C. 154(b) by 0 days.

(21) Appl. No.: 14/406,393

(22) PCT Filed: Jun. 4, 2013

(86) PCT No.: PCT/GB2013/051478
§ 371 (c)(1),
(2) Date: Dec. 8, 2014

(87) PCT Pub. No.: WO2013/182844
PCT Pub. Date: Dec. 12, 2013

(65) Prior Publication Data

US 2015/0188239 A1 Jul. 2, 2015

(30) Foreign Application Priority Data

Jun. 8, 2012 (GB) ..... 1210114.3

(51) Int. Cl.
*H01Q 21/24* (2006.01)
*H01Q 1/24* (2006.01)
(Continued)

(52) U.S. Cl.
CPC ..... *H01Q 21/24* (2013.01); *H01Q 1/243* (2013.01); *H01Q 13/00* (2013.01); *H01Q 13/10* (2013.01)

(58) Field of Classification Search
CPC ..... H01Q 21/24; H01Q 1/243; H01Q 13/00; H01Q 13/10
(Continued)

(56) References Cited

U.S. PATENT DOCUMENTS 4,975,711 A 12/1990 Lee
2009/0096699 A1 4/2009 Chiu et al.

FOREIGN PATENT DOCUMENTS

EP 0714151 A1 5/1996

OTHER PUBLICATIONS

Hong-Jun Tang, Kin-Fai Tong, Wei Hong :"low profile three-dimensional orthogonally polarized antennas", Publication form University college London, [Online] 2010, pp. 1-, Xp002710708, the whole document.

*Primary Examiner* — Dameon E Levi
*Assistant Examiner* — David Lotter
(74) *Attorney, Agent, or Firm* — Park, Vaughan, Fleming & Dowler LLP

(57) ABSTRACT

The antenna configuration disclosed herein can be used in a mobile telecommunications device to provide three-dimensional, orthogonal polarization. The antenna configuration comprises a half mode substrate integrated waveguide (HMSIW) antenna, a first thick-slot antenna and a second thick-slot antenna. The HMSIW antenna comprises two parallel conductive plates separated by a dielectric. The HMSIW antenna has a substantially rectangular shape comprising a first edge, a second edge substantially perpendicular to the first edge and connected to the first edge by a first corner, a third edge opposing and substantially parallel to the first edge and connected to the second edge by a second corner, and a fourth edge opposing and substantially parallel to the second edge and connected to the first edge by a third corner and to the third edge by a fourth corner. The first and second edges are open for radiation. The first thick-slot antenna includes a first dielectric strip extending from the third corner in a direction substantially parallel to and collinear with the first edge and away from the first corner. The second thick-slot antenna includes a second dielectric strip extending from the second corner in a direction substantially
(Continued)

parallel to and collinear with the second edge and away from the first corner. The two parallel plates of the I IMS1W antenna lie in a plane defined by the first and second dielectric strips. The first thick-slot antenna is responsible for linear polarization in a direction parallel to the first edge, the second thick-slot antenna is responsible for linear polarization in a direction parallel to the second edge, and the HMSIW antenna is responsible for linear polarization in a direction perpendicular to the parallel conductive plates of the HMSIW antenna.

20 Claims, 12 Drawing Sheets

(51) Int. Cl.
*H01Q 13/00* (2006.01)
*H01Q 13/10* (2006.01)

(58) Field of Classification Search
USPC ..... 343/702, 767, 770
See application file for complete search history.

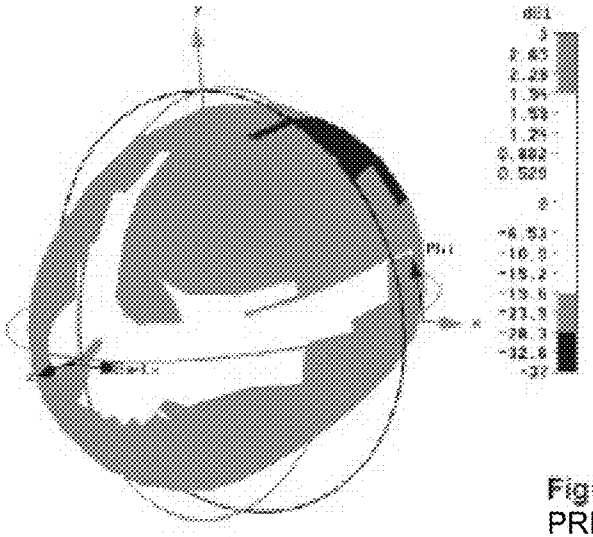
Figure 3(iii)
PRIOR ART

Ant I – z-directional polarization

Ant II – x-directional polarization

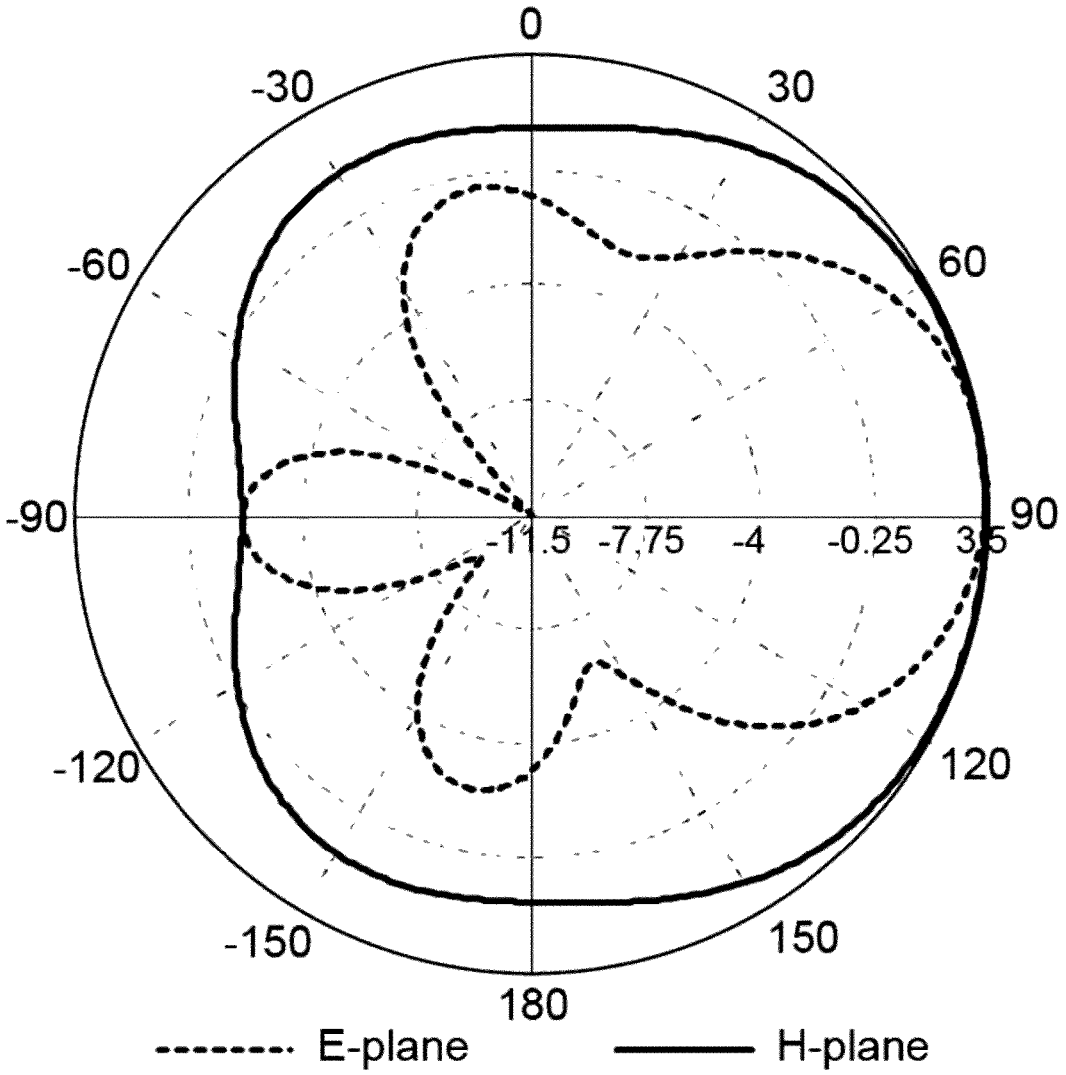
Figure 6(iii)
Ant III – y-directional polarization

ANTENNA CONFIGURATION FOR USE IN A MOBILE COMMUNICATION DEVICE

FIELD OF THE INVENTION

The present invention relates to an antenna configuration for use in a mobile communication device or a similar system, and in particular to a low profile antenna configuration which supports three-dimensional, orthogonal polarisation.

BACKGROUND OF THE INVENTION

In future wireless communication systems, a high data-rate and reliability are compulsory requirements. However, system performance is often degraded by the fading effect of channels. Diversity is commonly considered to be an effective method of improving system performance There are basically three routes available to realize diversity: space, polarization, and radiation pattern. Given the limited space and low profile structure of modern handheld devices, space and pattern diversity may be difficult to exploit successfully. On the other hand, polarization diversity, basically dual polarization, has been implemented in handheld devices with impressive performance [1-3]. In addition, the idea of three-dimensional (3D) polarization has recently been explored [4,5], with the suggestion that it can help to double or even triple the capacity of wireless systems. However, the most straightforward approach to providing three-dimensional (3D) polarization, namely the use of cubic structures, may not be practical to integrate with mobile devices easily in view of the relative physical dimensions [5], since they are generally rather flat devices—see also U.S. Pat. No. 7,710,343.

Accordingly, it has been proposed [9] to utilize the low profile characteristic of a half mode substrate integrated waveguide (HMSIW) antenna [6-8; 10, 11] to reduce significantly the thickness of a three-dimensional orthogonally polarized antenna. This low profile design is a good candidate for embedding into most mobile devices. The three radiating elements are closely located and the design has been carefully considered to match the nature of wave propagation in complex environments. Moreover, it is not necessary to insert any balun before connecting to the backend RF circuits. Such an antenna is designed to operate around 3.5 GHz and have an impedance bandwidth of more than 150 MHz, so that the antenna can support 4G wireless networks, such as WiMAX.

The geometry of a proposed three-dimensional orthogonally polarized antenna from [9] is shown in FIG. 1. The three-dimensional antenna has three radiating elements: Ant I and Ant II are basically thick-slot antennas, while Ant III is a HMSIW antenna. Coaxial probes are used for feeding all the three radiating elements. Ant I is responsible for the linear polarization in the x-direction, the polarization of Ant II is in the y-direction, while z-directional polarized radiation is contributed by the HMSIW antenna—Ant III.

The half mode substrate integrated waveguide antenna of FIG. 1 is basically a quarter of a substrate-filled circular parallel-plate waveguide with vertical walls on the two straight edges connecting the two parallel plates. The length of the arc is about half of the wavelength of the resonant frequency of the HMSIW antenna Impedance matching can be achieved by adjusting the location of the feeding probe.

Simulations of such an antenna using CST Microwave Studio are described in [9]. The dimensions of the whole simulated model are 70×70×9 mm (x×y×z), which is based on the size of smart phones in common use. The thickness and dielectric constant of the inserted substrate are 6.4 mm and 2.2 respectively. The size of the proposed overall antenna from [9] is about 38×38×9 mm. Detailed dimensions of the individual antennas (in mm) from [9] are presented in Table 1.

TABLE 1

Dimensions of the proposed antenna from [9] in mm

| | Ant I | Ant II | | Ant III |
|---|---|---|---|---|
| width | 3.0 | 3.0 | Radius | 28.8 |
| length | 23.0 | 24.8 | Thickness | 6.4 |
| thickness | 6.4 | 6.4 | Feed | 10.0 |
| feed | 14.4 | 14.4 | | |

FIG. 2 illustrates the S-parameters of the antennas from [9] for the antenna design shown in FIG. 1. It can be seen from FIG. 2 that the two slot antennas, Ant I and Ant II (S11, S22), have a wider impedance bandwidth (|Sii|<−10 dB) of 800 MHz from about 3.1 to 3.9 GHz, compared with the impedance bandwidth of Ant III. The operating frequency band of the whole antenna is therefore determined by the impedance bandwidth of the HMSIW antenna (Ant III). The impedance bandwidth of the HMSIW antenna (S33) is approximately 160 MHz from 3.44 to 3.60 GHz. The isolation between port 1 and port 2 (S21) is about −18 dB and better isolations of −45 dB are observed between port 3 and port 1 (S31) and between port 3 and port 2 (S32).

FIG. 3 illustrates the simulated gain and 3D radiation patterns at 3.5 GHz from [9] for the antenna shown in FIG. 1. In particular, FIG. 3(*i*) shows the results for Port 1, the x-directional linear polarization, FIG. 3(*ii*) shows the results for Port 2, the y-directional linear polarization, and FIG. 3(*iii*) shows the results for Port 3, the z-directional linear polarization. It can be seen that the maximum gain of the two thick-slot radiating elements is about 2.5 dBi and the HMSIW antenna has a higher maximum gain of 3 dBi. Based on the simulated results, three-dimensional orthogonal polarization can be achieved by exciting Ant I, II and III cooperatively. The variation of gain at different angles is less than 3 dB, which is suitable for mobile communications.

In the implementation of [9], two thick-slot antennas are responsible for the two planar polarizations, while the third perpendicular polarization is contributed by an HMSIW antenna. The thickness of the antenna is shrunk by the inherent thin structure of an HMSIW antenna. The simulated performance of such a low profile three-dimensional orthogonal polarization antenna demonstrates that reasonable impedance bandwidth and isolation between ports can be obtained.

Although the antenna configuration of [9] provides significant benefits over known antenna configurations for providing three-dimensional, orthogonal polarization for use in a mobile communication device, especially in allowing a low profile or substantially planar geometry, there continues to be a need to reduce the space occupied by such an antenna configuration, such as for embedding in a compact, mobile, handheld device, and to improve its performance.

SUMMARY OF THE INVENTION

The invention is defined in the appended claims.

The approach described herein relates to a low profile antenna configuration for use in a mobile communication device or a similar system, and in particular to a low profile antenna configuration which supports three-dimensional, orthogonal polarisation.

One embodiment of the invention provides an antenna configuration for use in a mobile telecommunications device to provide three-dimensional, orthogonal polarisation. The antenna configuration comprises: a half mode substrate integrated waveguide (HMSIW) antenna comprising two parallel conductive plates separated by a dielectric, said HMSIW antenna having a substantially rectangular shape comprising a first edge, a second edge substantially perpendicular to the first edge and connected to the first edge by a first corner, a third edge opposing and substantially parallel to the first edge and connected to the second edge by a second corner, and a fourth edge opposing and substantially parallel to the second edge and connected to the first edge by a third corner and to the third edge by a fourth corner, wherein the first and second edges are open for radiation; a first thick-slot antenna including a first dielectric strip extending from the third corner in a direction substantially parallel to and collinear with the first edge and away from the first corner; and a second thick-slot antenna including a second dielectric strip extending from the second corner in a direction substantially parallel to and collinear with the second edge and away from the first corner. The two parallel plates of the HMSIW antenna lie in a plane defined by the first and second dielectric strips. The first thick-slot antenna is responsible for linear polarisation in a direction parallel to the first edge, the second thick-slot antenna is responsible for linear polarisation in a direction parallel to the second edge, and the HMSIW antenna is responsible for linear polarisation in a direction perpendicular to the parallel conductive plates of the HMSIW antenna.

In some embodiments, the first thick-slot antenna further comprises a first conductive strip aligned with the first dielectric strip. The first conductive strip is shorter than said first dielectric strip to form a first open slot for radiation at one end of the first dielectric strip. The first thick-slot antenna further comprises a first conductive wall structure parallel to the first conductive strip and separated from the first conductive strip by the first dielectric strip. The first conductive wall structure is connected to the opposite end of the first conductive strip from the first open slot. The second thick-slot antenna further comprises a second conductive strip aligned with the second dielectric strip. The second conductive strip is shorter than said second dielectric strip to form a second open slot for radiation at one end of the second dielectric strip. The second thick-slot antenna further comprises a second conductive wall structure parallel to the second conductive strip and separated from the second conductive strip by the second dielectric strip. The second conductive wall structure is connected to the opposite end of the second conductive strip from the second open slot. The first open slot for radiation is adjacent to the third corner of the HMSIW antenna, but separated from said third corner of the HMSIW antenna by a portion of the first conductive wall structure. The second open slot for radiation is adjacent to the second corner of the HMSIW antenna, but separated from said second corner of the HMSIW antenna by a portion of the second conductive wall structure. The first conductive wall structure, the second conductive wall structure, and a conductor lining the third and fourth edges of the HMSIW antenna may be formed as a single conductor element. In some embodiments, the third and fourth edges of the HMSIW antenna are lined by a conductor, while in other embodiments, the third and fourth edges of the HMSIW antenna are lined by via holes.

It will be appreciated that this configuration is described by way of example, and other implementations may differ. For example, the first conductive wall structure, the second conductive wall structure, and the conductor lining the third and fourth edges of the HMSIW antenna may be formed as two or more separate structures.

In some embodiments, the dielectric of the HMSIW antenna is selected to provide an impedance bandwidth (20 $\log|S_{ii}|<-10$ dB) of 150 MHz or greater. The thickness and dielectric constant of the dielectric of the HMSIW antenna are approximately 6.4 mm and 2.2 respectively. The HMSIW antenna has a substantially square shape, whereby the length of the first edge equals the length of the second edge, and is in the range 18-30 mm. The length of the first edge and the length of the second edge may both be approximately 21 mm. The first thick-slot antenna has a length, measured in a direction parallel to said first dielectric strip, in the range 12-25 mm. The second thick-slot antenna has a length, measured in a direction parallel to said second dielectric strip, in the range 12-25 mm. The length of the first thick-slot antenna may be approximately 17 mm, and the length of the second thick-slot antenna may be approximately 17 mm. The first thick-slot antenna has a width, measured in a direction parallel to said second dielectric strip, in the range 2.5-4 mm, and the second thick-slot antenna has a width, measured in a direction parallel to said first dielectric strip, in the range 2.5-4 mm. The first corner of the HMSIW antenna may be rounded or bevelled. It will be appreciated that these dimensions and parameters are provided by way of example only, and different implementations may adopt different values for the dimensions, different parameters, and so on, depending upon the particular circumstances of any given implementation.

Overall, the above dimensions and operating parameters are well-suited to providing a low profile antenna configuration for incorporation into a smartphone or similar device. Such a low profile antenna configuration is generally understood to have a thickness (representing the minimum dimension) equal to or less than 10% of the operating wavelength in free space. For example, the free space wavelength at 3.5 GHz is about 86 mm, so that 10% of this wavelength is 8.6 mm, which is greater than the thickness of 6.4 mm in the embodiment described above.

In some embodiments, the antenna configuration includes a battery pack which forms at least part of the dielectric of the HMSIW antenna. The battery pack is configured to provide power to a mobile communication device that incorporates the antenna configuration.

DETAILED DESCRIPTION

Figure 4:
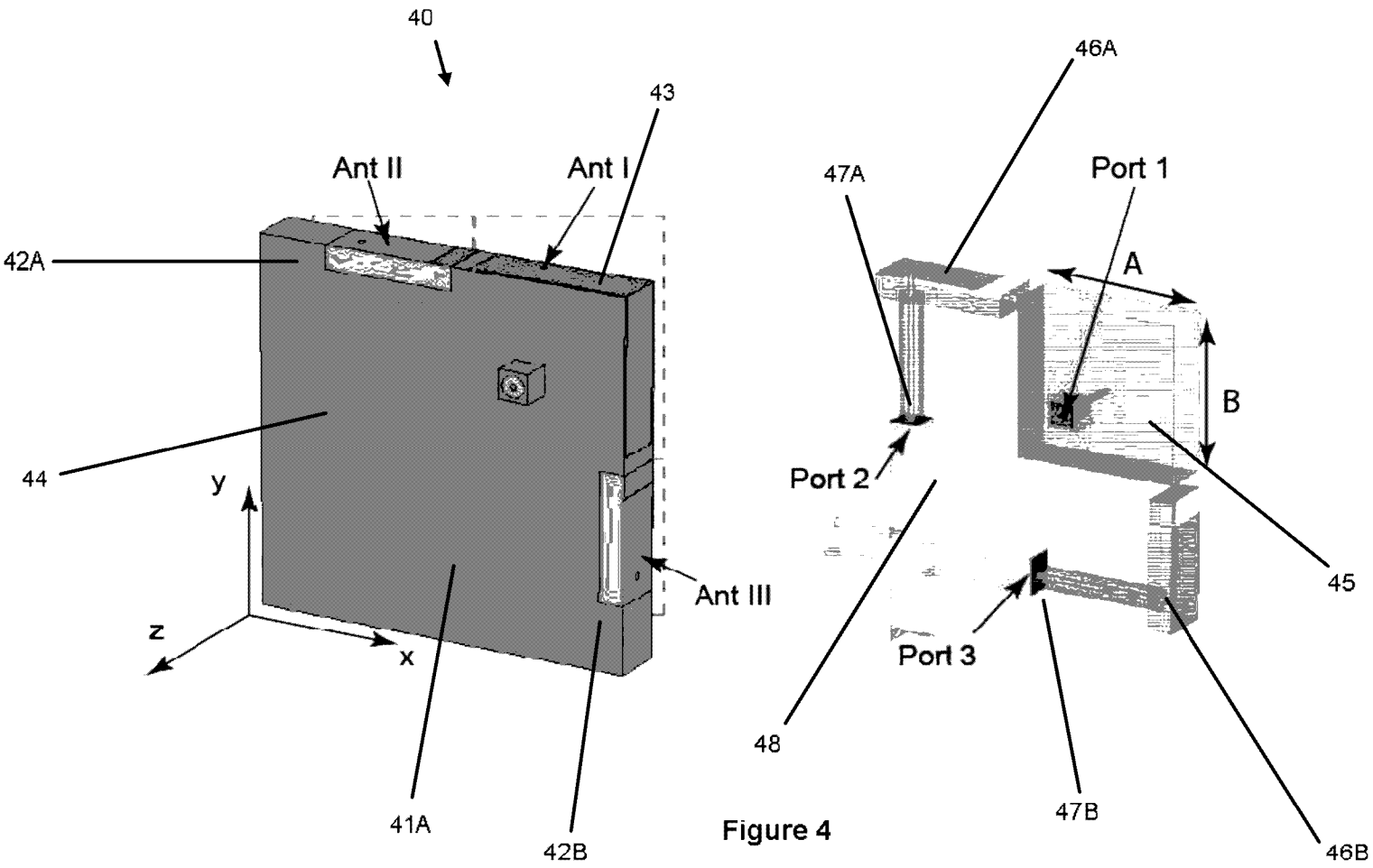
FIG. 4 illustrates the geometry of a low profile 3D orthogonally polarised antenna in accordance with one embodiment of the invention.

FIG. 4 illustrates the geometry of a low profile antenna configuration that supports 3D orthogonal polarization in accordance with one embodiment of the invention. As with the antenna configuration of FIG. 1, the three-dimensional antenna configuration consists of three radiating elements. In FIG. 4 (which has slightly different labelling from FIG. 1), Ant II and Ant III are thick-slot antennas, while Ant I is a HMSIW antenna. Coaxial probes are used to feed all three radiating elements. Ant II is responsible for the linear polarization in the x-direction and the linear polarization of Ant III is in the y-direction, while z-directional polarized radiation is contributed by the HMSIW antenna—Ant I.

FIG. 4 presents two depictions of an antenna configuration 40. The antenna configuration comprises two square or rectangular parallel conductive (metallic) plates facing one another. In the left-hand depiction, one plate 41A (referred to for convenience as the top plate) is visible. In the right-hand depiction, the top plate and also the opposing bottom plate have been removed to provide a view of the internal components of the antenna configuration that occupy the space between the two parallel plates that face one another.

The antenna configuration 40 comprises two thick slot antennas 42A, 42B (Ant II and Ant III) and one HMSIW antenna 43 (Ant I). The HMSIW antenna comprises a square or rectangular slab of dielectric material 45 sandwiched between the two parallel plates, in one corner thereof. A via 44 is defined through the top plate 41A to act as a port 1 to the HMSIW antenna 43. The frequency of the HMSIW antenna 43 is dependent on the dimensions of the HMSIW antenna. In particular, the distance along two adjacent sides, denoted as A and B (shown in the right-hand depiction of FIG. 4), represents a half-wavelength of the radiation generated, so the physical size of the HMSIW antenna is arranged to produce radiation having the desired wavelength. Because of this relatively simple geometry, the operating frequency of the HMSIW antenna and the two slot antennas can be readily altered by scaling the physical dimensions of the antenna configuration as appropriate.

The relative permittivity of the dielectric material 45 impacts the size and operating bandwidth of the HMSIW antenna, in that a lower relative permittivity generally results in a larger size of HMSIW antenna for a given frequency, but at the same time also has a wider frequency bandwidth. In other words, there is a trade-off in that increasing the relative permittivity can help to produce a smaller device for a given operating frequency, but at the same time the operating frequency bandwidth will be somewhat reduced (compared with the use of a dielectric material having a lower relative permittivity).

The thick slot antennas 42A and 42B are formed using strips of metal perpendicular to the parallel plates 41. The strips effectively span the gap between the parallel plates. Moreover, the strips are separated from the parallel plates by lengths of dielectric material 46A, 46B that extend along the length of metal strips on the inside of these strips (i.e. towards the interior of the antenna configuration). One end of each metallic strip is connected to a metallic sidewall spanning the two parallel plates, while the other (opposite) end of the metallic strip is left open to form the radiation slot. Each thick slot antenna is fed by a corresponding port 47A, 47B (port 2 and port 3) and a feed line that extends perpendicular from the strip into the antenna configuration. The length and configuration of the feed lines and also the exact locations of the ports can be varied, both for the purpose of impedance matching, and also to facilitate the overall layout of the device. One possibility is that the length of a feed line is changed to provide a direct connection between a slot antenna and a radio frequency (RF) circuit.

In one embodiment, the remaining space between the parallel plates, e.g. region 48, is utilised to provide battery storage. It will be appreciated that battery lifetime is a very important parameter for most mobile devices, and so being able to supplement the available battery capacity, such as by using space 48 within the antenna configuration, is extremely helpful.

The overall sizing of the antenna configuration of FIG. 4 is about 40×40×7 mm. The thickness and dielectric constant of the inserted substrate are 6.4 mm and 2.2 respectively. Detailed dimensions of the individual antennas within the overall antenna configuration of FIG. 4 are given in Table 2.

TABLE 2

Dimensions of the antenna configuration of FIG. 4 in mm

| | Ant I | Ant II | Ant III |
|---|---|---|---|
| length in x-direction | 21.2 | 17.4 | 3.2 |
| length in y-direction | 21.2 | 3.2 | 17.4 |
| length in z-direction | 6.4 | 6.4 | 6.4 |

Figure 1:
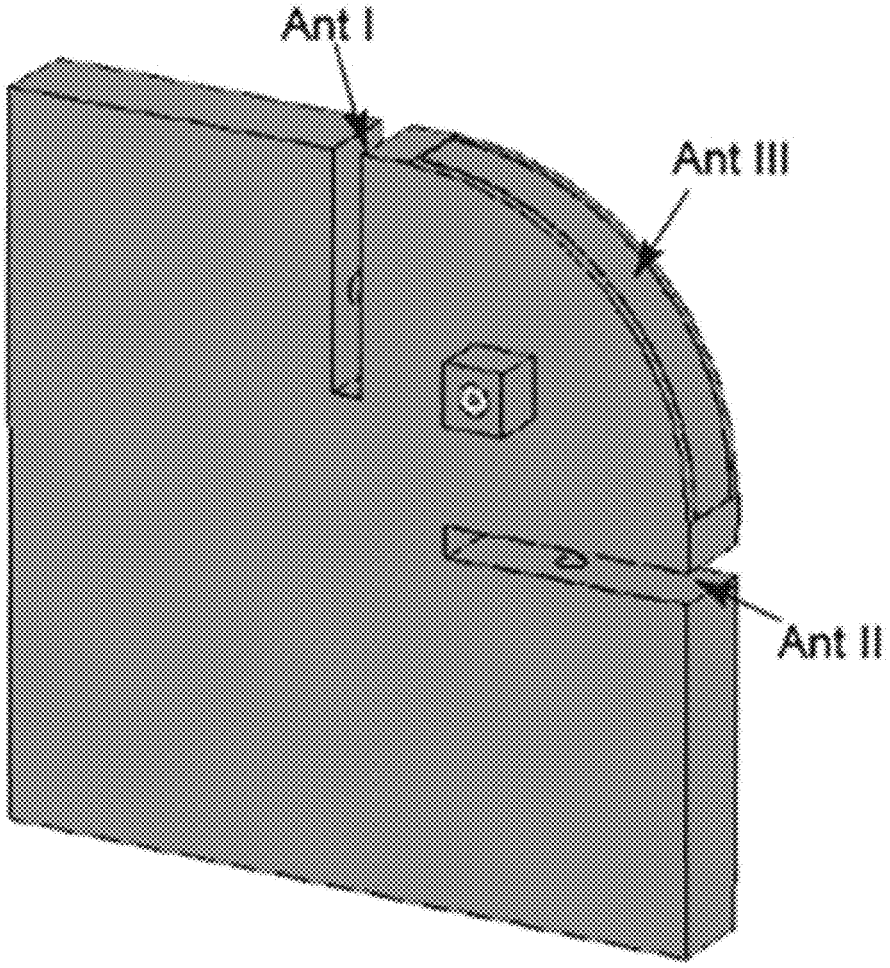
Figure 1 PRIOR ART
FIG. 1 illustrates the geometry of a known low profile 3D orthogonally polarised antenna.
Figure 2:
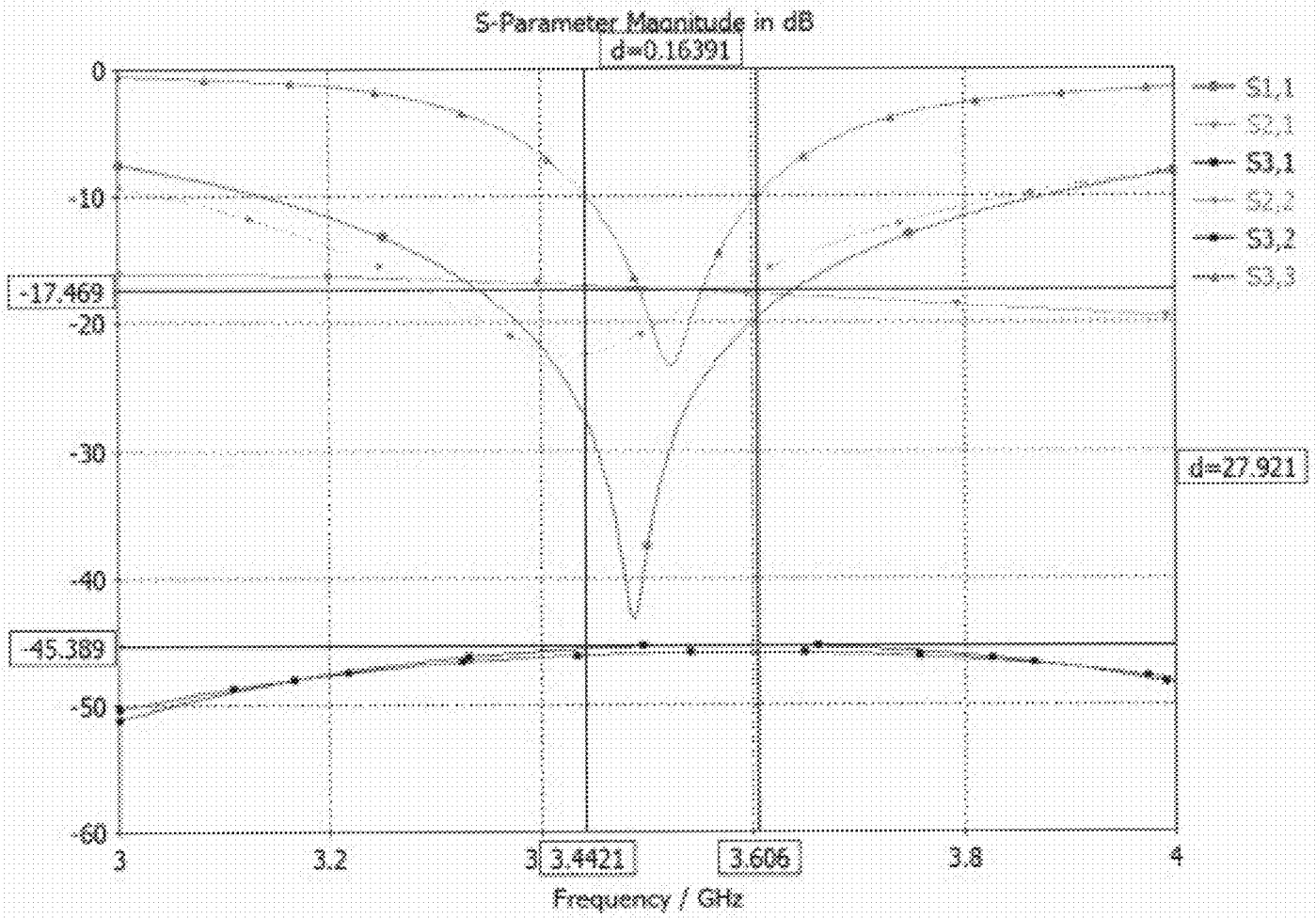
Figure 2 PRIOR ART
FIG. 2 illustrates the S-parameters of the antenna of FIG. 1.
Figure 3I:
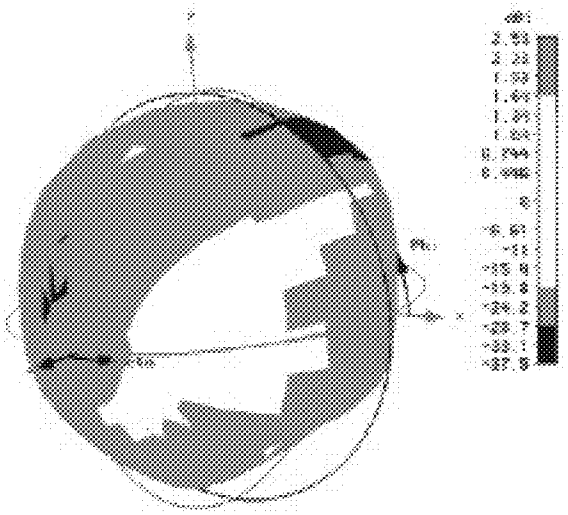
Figure 3(i) PRIOR ART
FIG. 3 illustrates the gain and 3D radiation patterns at 3.5 GHz for the antenna of FIG. 1.
Figure 3:
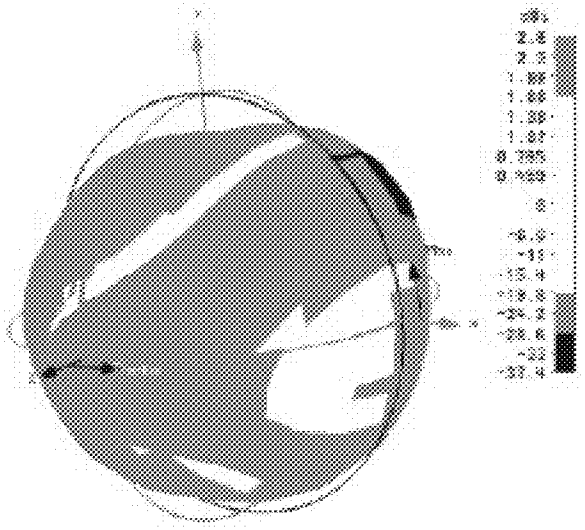
Figure 3(ii) PRIOR ART

The antenna configuration of FIG. 4 has various advantages when compared with the antenna configuration of FIG. 1 (and as disclosed in [9]). Firstly, the two slot antennas are now located along the periphery of the overall configuration (compared with extending into the interior of the configuration as shown in FIG. 1). This reduces the risk that the performance of the two thick-slot antennas might be reduced if they are covered by other components within a mobile device, such as a screen, since the peripheral location of the two slot antennas helps to minimise the extent of any such overlap. Furthermore, locating the two slot antennas along the outside of the overall configuration opens up additional space in the device (particularly if the location of ports 2 and 3 is somewhat altered from that shown in FIG. 4). Moreover, the usability of such space (for other purposes) is improved, given the peripheral positioning of the two slot antennas of FIG. 4.

The provision of a rectangular corner for the HMSIW antenna of FIG. 4, compared with the quarter-circle arc shown in FIG. 1, allows the HMSIW antenna 40 of FIG. 4 to be located close into the corner of a mobile device. In addition, the dimensions of the HMSIW antenna of FIG. 4 are reduced compared with the HMSIW antenna of FIG. 1 for a given operating frequency. Thus if we assume a unit radius to the curve of FIG. 1, the curved side (arc) has a length of n/2, compared with a corresponding length of 2 (=A+B) for the rectangular or square arrangement of FIG. 4. This therefore leads to a linear reduction in scale of over 20% for the arrangement of FIG. 4 compared with the arrangement of FIG. 1 (assuming the same operating frequency and dielectric material is used in both cases).

Simulations of the antenna configuration of FIG. 4 were performed using CST Microwave Studio. The whole simulated model was 70×70×7 mm (x×y×z), which reflects the sizes of smart phones commonly used today.

Figure 5I:
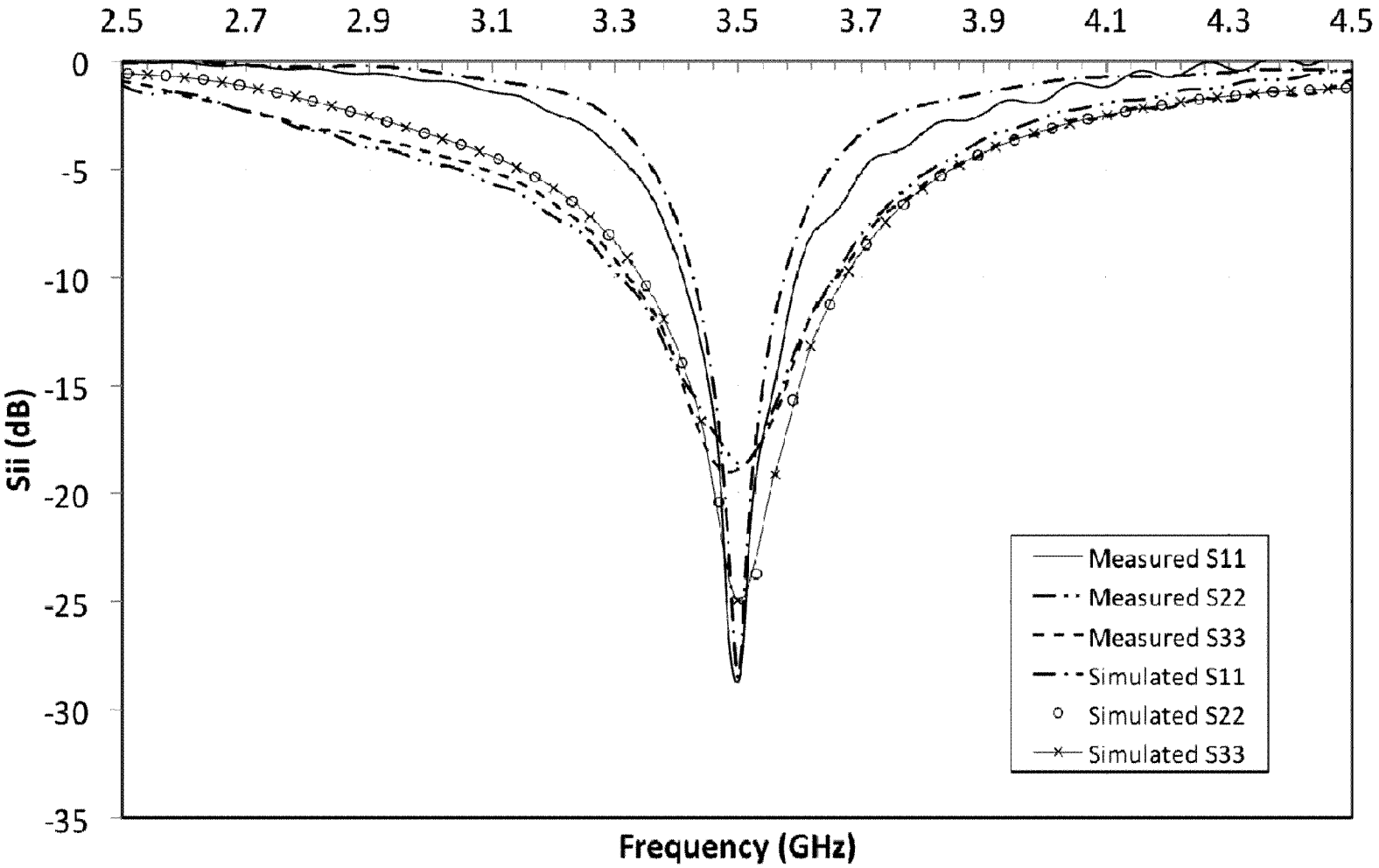
FIG. 5 illustrates the S-parameters of the antenna of FIG. 4.
Figure 5:
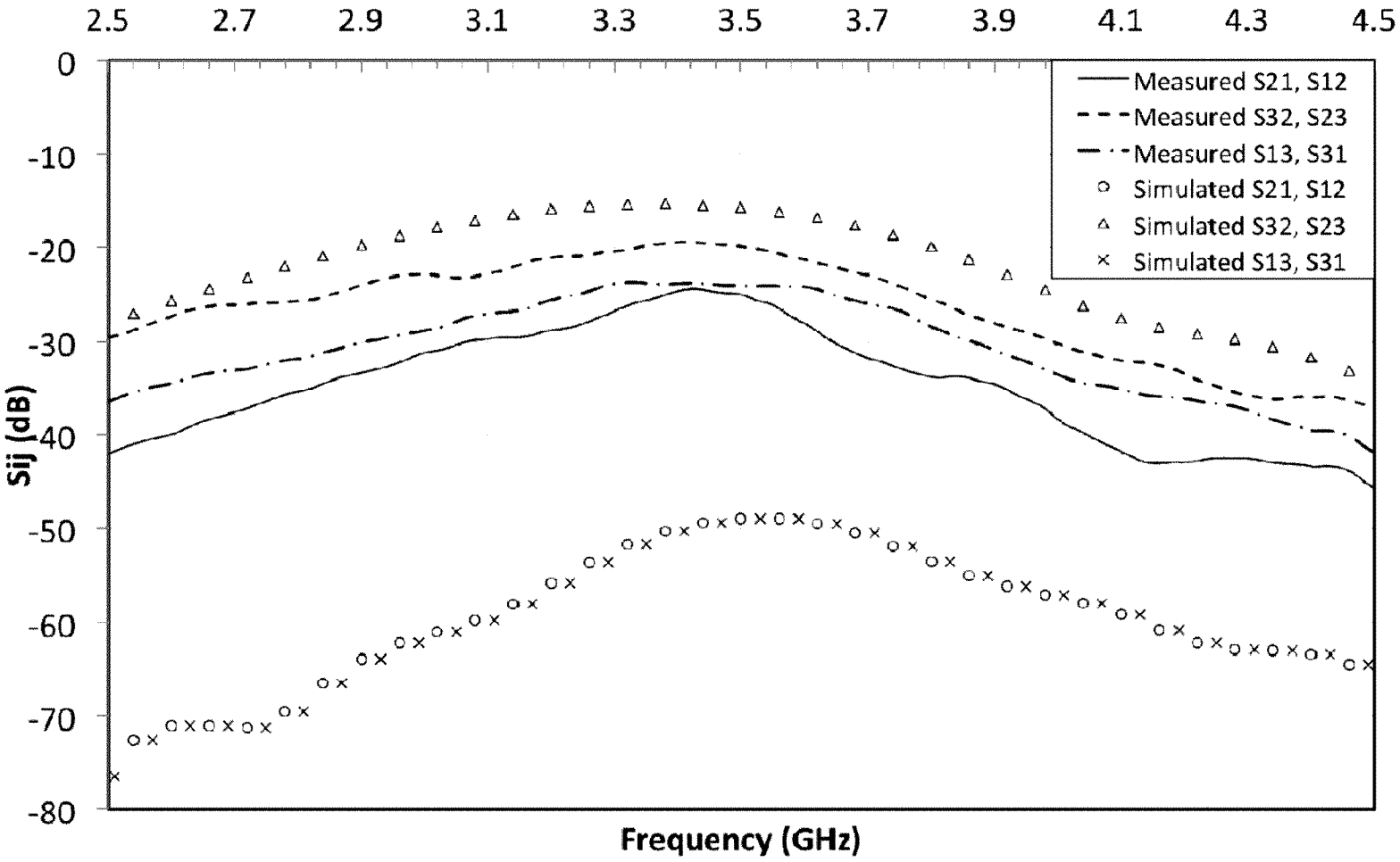

FIG. 5 illustrates both measured and simulated S-parameters of the antenna configuration of FIG. 4, where FIG. 5(*a*) depicts Self-reflections (effectively the inverse of the transmitting power of an individual antenna), and FIG. 5(*b*) reflects Isolations between different antennas. The differences between the measured and simulated parameters arise because of physical differences between the simulated model and the prototype antenna. Thus the simulation only includes the input ports, whereas for the real-life measurements, the effects of the cables and connectors are also important.

As can be seen from the values of S11 in FIG. 5, the operating frequency band of the whole antenna configuration is determined primarily by the impedance bandwidth ($20 \log|S_{ii}|<-10$ dB) of the HMSIW antenna (Ant I). The impedance bandwidth of Ant I is approximately 170 MHz from 3.43 to 3.60 GHz, which is wide enough to fulfill the bandwidth requirement of 150 MHz for 4G mobile communications. The two slot antennas, Ant II and Ant III, have a wider measured impedance bandwidth of 330 MHz from about 3.32 to 3.65 GHz.

The measured isolation between Ant II and Ant III ($S_{32}$, $S_{23}$) at 3.5 GHz is about −20 dB. A better isolation of −25 dB is observed between Ant I and Ant II ($S_{21}$, $S_{12}$), and also between Ant I and Ant III ($S_{13}$, $S_{31}$). A defected ground structure design can be used to improve further the isolation between the different antennas to suppress the correlation between channels, thereby supporting an even faster data rate [12].

Figure 6I:
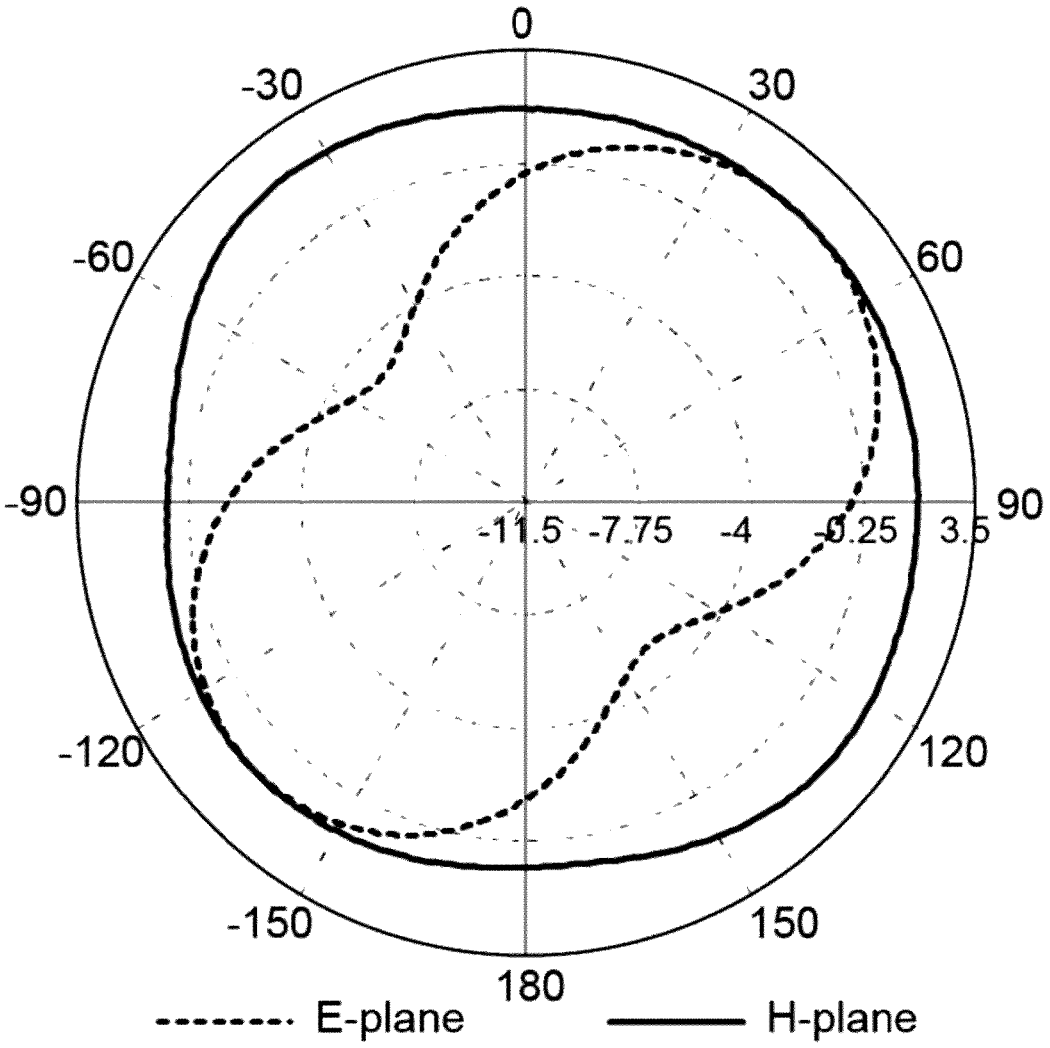
FIG. 6 illustrates the gain and 2D radiation patterns at 3.5 GHz for the antenna of FIG. 4.
Figure 6:
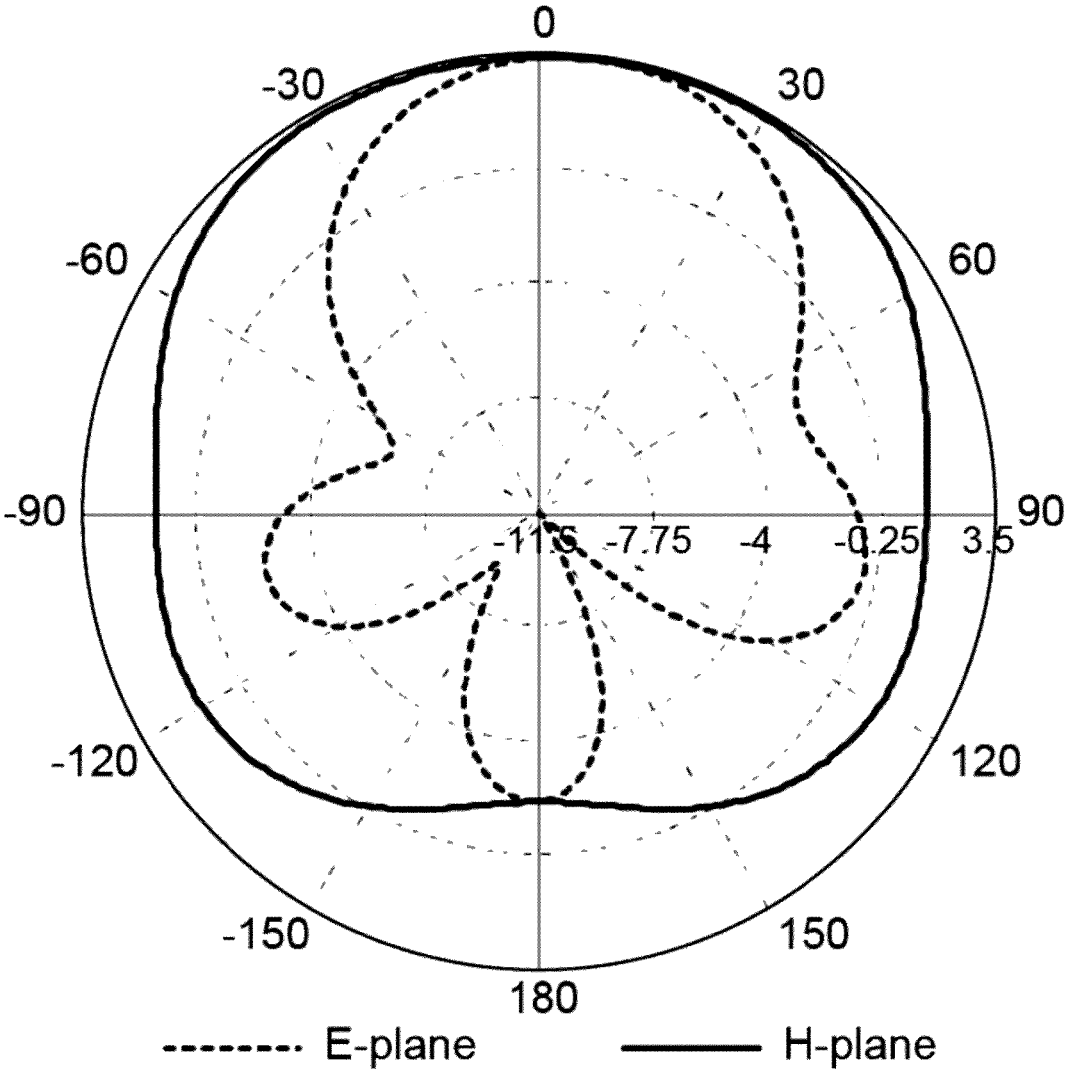

The gains and 2D radiation patterns at 3.5 GHz of the antenna configuration of FIG. 4 have also been simulated and are illustrated in FIG. 6. The maximum gain of the two thick-slot radiating elements is about −3.5 dBi and the HMSIW antenna has a higher maximum gain of −1.9 dBi. Based on the simulated results, three-dimensional orthogonal polarization can be achieved by exciting Ant I, II and III cooperatively.

Figure 7:
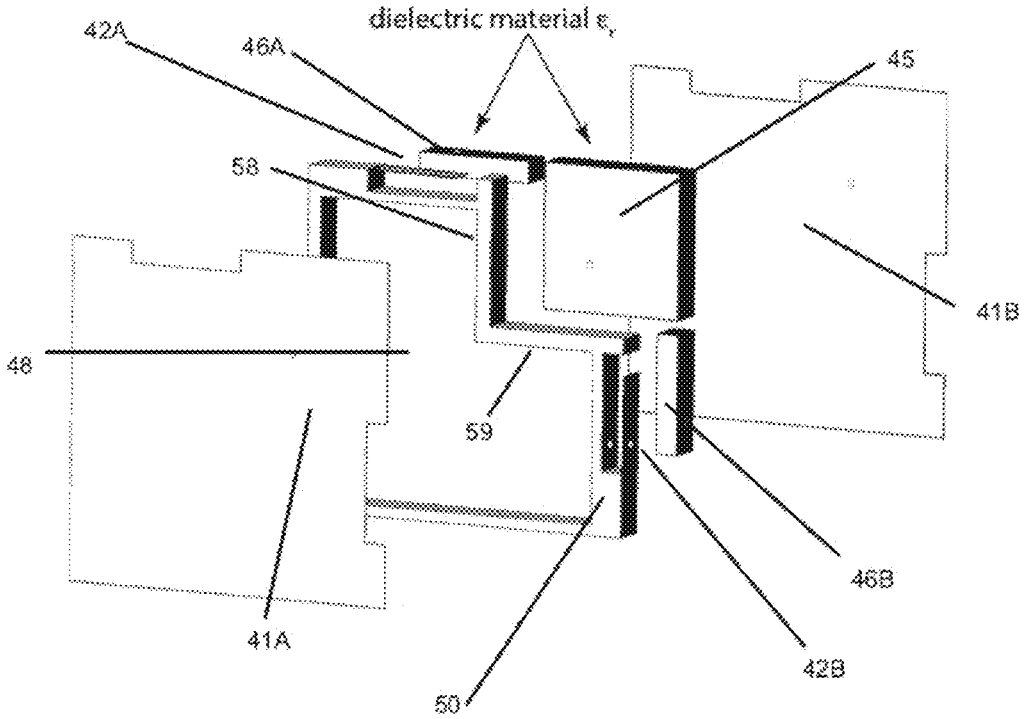
FIG. 7 is an exploded view of the antenna structure of FIG. 4 in accordance with one embodiment of the invention.

FIG. 7 provides an exploded view of the antenna configuration of FIG. 4 using consistent reference numerals, except that the feed-lines and ports for the strip antennas are omitted. Note that these feed-lines and ports may be located as shown in FIG. 4, or a different configuration might be adopted. FIG. 7 illustrates the two opposing conductive (metallic) plates 41A and 41B and a wall structure 50, which is also conductive (metallic) that spans and separates the opposing plates 41A and 41B. In one corner of the antenna configuration 40, the wall structure 50 defines two sides of the HMSIW antenna 43, which is filled between plates 41A and 41B with non-conductive dielectric material 45. The two sides of dielectric material 45 that form external edges of the HMSIW antenna 43 (top-right in FIG. 7) are open for radiation at the desired operating frequency of the HMSIW antenna 43, while the two opposite, internal sides or edges of the dielectric material 45 (bottom-left in FIG. 7) are lined by wall 58 (left) and wall 59 (bottom). In the embodiment of FIG. 7, walls 58 and 59 are solid conductor walls that are part of the wall structure 50. However, in other embodiments, wall 58 and/or wall 59 may be formed by a row of via holes between the two parallel plates 41A, 41B, where the radius of and spacing between the via holes is configured based on the desired operating frequency of the HMSIW antenna 43. The rows of via holes or the solid conductor walls 58, 59 are substantially reflective (and non-transmissive) for radiation at the desired operating frequency of the HMSIW antenna 43.

The two slot antennas 42A and 42B, which are shown in FIG. 7 located along (and parallel to) the perimeter of the antenna configuration 40, are also formed in the wall structure 50 by incorporating respective dielectric strips 46A and 46B. Note that the dielectric material 45, 46 may, in some embodiments, be air. In addition, dielectric slab 45 and dielectric strips 46A, 46B may all comprise the same dielectric material, or they may comprise different materials, depending upon the particular requirements of any given embodiment. For example, different dielectric materials might be used in different antennas for further optimization, such as size reduction of a particular antenna. The dielectric constant (relative permittivity) for the dielectric slab 45 and the dielectric strips 46A and 46B is generally in the range 1-10 (if the dielectric constant is too high, the antennas tend to behave more like capacitors).

Note that region 48, which is located between the parallel plates 41A, 41B but away from the HMSIW antenna 43, is not occupied by any component of the antenna configuration itself, but rather can be utilised as space for other components. This space is more extensive and more integrated (less fragmented), and hence easier to exploit, than any such space in the implementation shown in FIG. 1.

Figure 8:
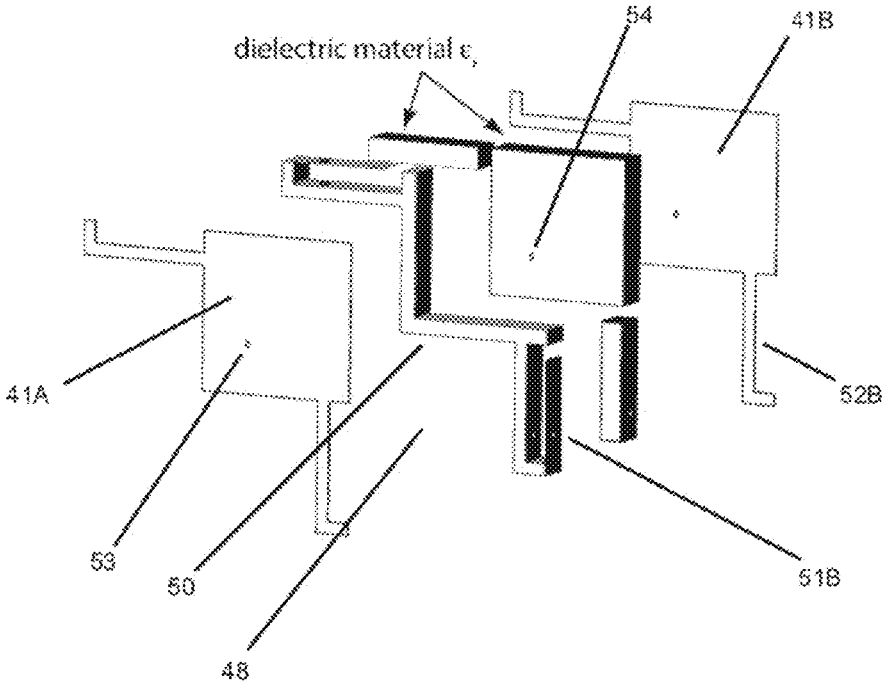
FIG. 8 is an exploded view of another antenna structure in accordance with a further embodiment of the invention.

FIG. 8 illustrates another embodiment of the antenna configuration. This differs from the embodiment of FIG. 7, in that the parallel plates 41A and 41B are primarily limited in extent to just covering the HMSIW antenna 43. The two plates also include two legs or strips, such as indicated by strip 52B, that extend respectively over each of the slot antennas 42A and 42B. As previously mentioned, each slot antenna includes a metal strip, such as strip 51B, that lies along the perimeter of the antenna configuration. The slot antenna outputs radiation from the gap between the end of the strip 51B and the wall structure 50. FIG. 8 also illustrates the feed points for the three antennas in the antenna configuration 40. For example, the antenna feed is connected to the HMSIW antenna 43 in the top plate 41A as indicated by reference numeral 53, while reference numeral 54 indicates a hole in the dielectric 45 for a feed pin to pass into electrical contact with the opposing plate 41B.

Figure 10:
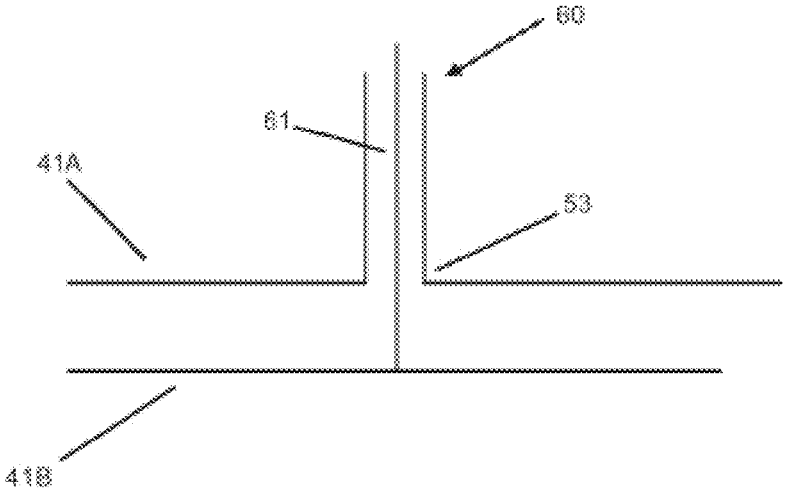
FIG. 10 is a schematic view of a feed to the antenna of FIG. 4, 8 or 9 in accordance with one embodiment of the invention.

FIG. 10 illustrates in highly schematic form (not to scale), a coaxial feed 60 into the HMSIW antenna 43. In particular, the outer conductive path of feed 60 joins at connection 53 to the parallel plate 41A, while the central pin 61 of feed 60 passes through plate 41A (without touching), and likewise through a hole 54 in the dielectric 45 (not shown in FIG. 10) to contact the opposing plate 41B. Note that a generally analogous configuration to that shown in FIG. 10 is also used for the feeds to the two slot antennas (which have opposing strips corresponding to opposing plates 41A and 41B). However, the feed arrangement is not limited to the particular configuration or approach shown in FIG. 10, and any suitable form of feed can be utilised.

Figure 9:
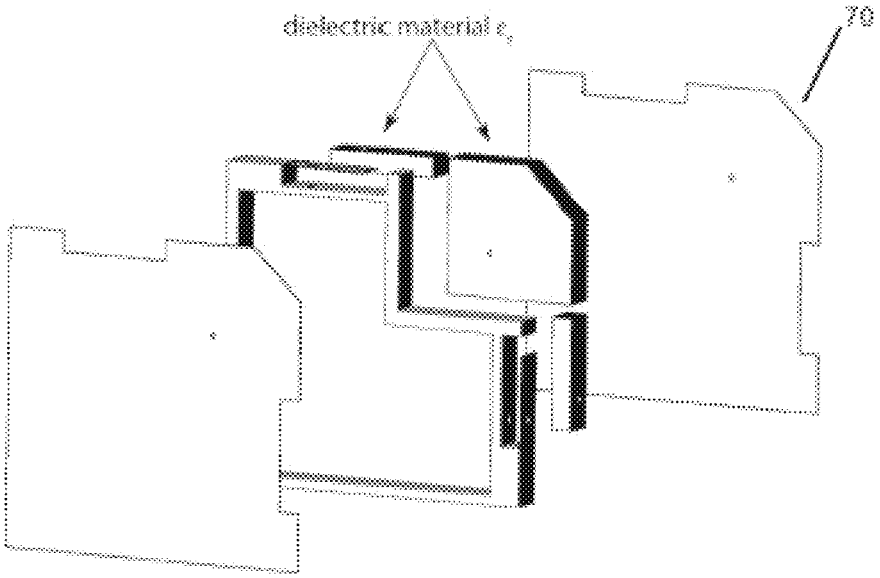
FIG. 9 is an exploded view of another antenna structure in accordance with a further embodiment of the invention.

FIG. 9 illustrates another embodiment of antenna configuration 40. This configuration is generally similar to that shown in FIGS. 4, 7 and 8, except that the outermost corner 70 of the HMSIW antenna 43 is chamfered or bevelled. Although this will slightly increase the size of the HMSIW antenna 43 for a given operating frequency (because the perimeter length is shortened), in practice it may allow the antenna configuration 40 to be accommodated more easily and effectively into a handheld mobile device, since these often have rounded corners. Note that in contrast to the arrangement of FIG. 1, in which the outer edge of the HMSIW antenna 43 is nearly all rounded, in FIG. 9 the majority of each of the two external edges of the HMSIW antenna 43 are straight, and only a minor portion of each of the two external edges is bevelled.

In one embodiment of the antenna configuration 40, the dielectric material 45 of the HMSIW antenna 43 comprises a small battery pack which is sandwiched between the two conductive plates 41A, 41B. The battery pack operates at DC (0 Hz) whereas the HMSIW antenna involves an AC (RF) signal at 3.5 GHz. Given this very large difference in operating frequency, the battery pack does not interfere electrically with the HMSIW antenna, except that the battery pack can be used to provide some or all of the dielectric material 45 of the HMSIW antenna 43. The dimensions of the HMSIW antenna are adjusted (resealed) to accommodate both the physical dimensions of the battery pack and also its electrical properties (dielectric constant). The HMSIW antenna 43 and the battery pack may be provided with their own, separate, electrical connections, or they may share the same connections, with an appropriate conductor and/or inductor to separate out the two functions at the back-end.

Figure 11:
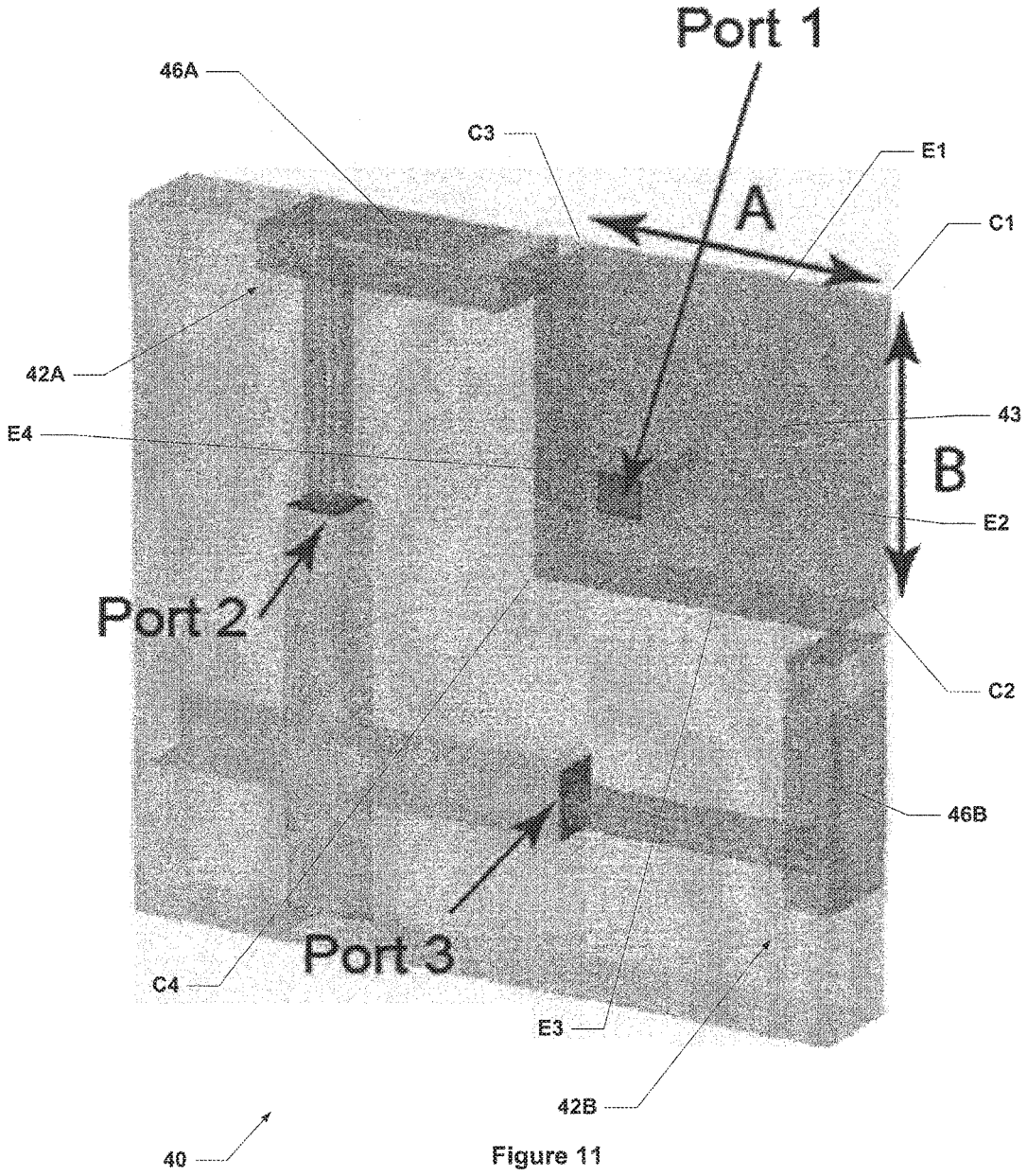
FIG. 11 is a further illustration of the low profile 3D orthogonally polarized antenna of FIG. 4.

FIG. 11 is another view of the antenna configuration 40 of FIG. 4 to provide three-dimensional, orthogonal polarisation. The antenna configuration comprises a half mode substrate integrated waveguide (HMSIW) antenna 43 comprising two parallel conductive plates separated by a dielectric. The HMSIW antenna has a substantially rectangular shape comprising a first edge E1, a second edge E2 perpendicular to the first edge and connected to the first edge by a first corner C1, a third edge E3 opposing and parallel to the first edge E1 and connected to the second edge E2 by a second corner C2, and a fourth edge E4 opposing and parallel to the second edge E2 and connected to the first edge E1 by a third corner C3 and to the third edge E3 by a fourth corner C4. The first and second edges E1, E2 are open for radiation.

A first slot antenna 42A includes a first dielectric strip 46A extending, from the third corner C3, in a direction which is parallel to and collinear with the first edge E1 and away from the first corner C1. A second slot antenna 42B includes a second dielectric strip 46B extending, from the second corner C2, in a direction which is parallel to and collinear with the second edge E2 and away from the first corner C1. The two parallel plates of the HMSIW antenna (see FIGS. 7 and 8) lie in a plane defined by the first and second dielectric strips. The first slot antenna is responsible for linear polarisation in a direction parallel to the first edge E1, the second slot antenna is responsible for linear polarisation in a direction parallel to the second edge E2, and the HMSIW antenna is responsible for linear polarisation in a direction perpendicular to the parallel conductive plates of the HMSIW antenna.

In conclusion, a low profile three-dimensional orthogonally polarized antenna has been provided. The antenna has two thick-slot antennas which are responsible for the two planar polarizations, while the third perpendicular polarization is contributed by an HMSIW antenna. The antenna has a low thickness, due to the inherent thin structure of an HMSIW antenna. The impedance bandwidth and isolations between ports have been obtained via measured and simulated performance and good results have been obtained.

The skilled person will be aware of various modifications of the antenna configuration described herein, according to the particular circumstances of any given implementation. For example, the skilled person will recognise that various features of the different embodiments described herein can generally be swapped or combined within one another. The presently claimed invention is defined by the appended claims and their equivalents.

REFERENCES

[1] N. Michishita and H. Arai, "A polarization diversity antenna by printed dipole and patch with a hole," in *Proc. IEEE Antennas Propag. Soc. Int. Symp.*, Boston, Mass., Jul. 8-13, 2001, vol. 3, pp. 305-308.

[2] D. Su, J. J. Qian, H. Yang, and D. Fu, "A novel broadband polarization diversity antenna using a cross-pair of folded dipoles," *IEEE Antennas Wireless Propag. Lett.*, vol. 4, pp. 433-435, 2005.

[3] D. D. Stancil, A. Berson, J. P. Van't Hof, R. Negi, S. Sheth, and P. Patel, "Doubling wireless channel capacity using co-polarized, co-located electric and magnetic dipoles," *IEE Electron. Lett.*, vol. 39, no. 14, pp. 746-747, July 2002.

[4] M. R. Andrews, P. P. Mitra, and R. de Carvalho, "Tripling the capacity of wireless communications using electromagnetic polarization," *Nature*, vol. 409, no. 6818, pp. 316-318, January 2001.

[5] Chi-Yuk Chiu, Jie-Bang Yan, R. D. Murch, "Compact Three-Port Orthogonally Polarized MIMO Antennas," *Antennas and Wireless Propagation Letters*, IEEE, vol. 6, pp. 619-622, 2007.

[6] W. Hong, B. Liu, Y. Q. Wang, Q. H. Lai, and K. Wu, "Half Mode Substrate Integrated Waveguide: A New Guided Wave Structure for Microwave and Millimeter Wave Application," *Joint* 31*st Conf. on Infrared and Millimeter Waves and* 14*Int. Conf. on Terahertz Electronics*, Shanghai, Sep. 18-22, 2006.

[7] Wei Hong, Bing Liu, Guoqing Luo, et al., "Integrated microwave and millimeter wave antennas based on SIW and HMSIW technology," 2007 *International Workshop on Antenna Technology: Small and Smart Antennas Metamaterials and Applications,* 21-23 Mar. 2007, pp. 69-72.

[8] J. F. Xu, W. Hong, H. J. Tang et al., "Half-mode substrate integrated waveguide (HMSIW) leaky-wave antenna for millimeter-wave applications," *IEEE Antennas and Wireless Propagation Letters*, Vol. 7 pp. 85-88, 2008.

[9] H.-J. Tang, K.-F. Tong, and W. Hong, "Low profile three-dimensional orthogonally polarized antennas," *Proc. ISAP* 2010, Macao, China, 23-26 Nov. 2010.

[10] Hong Jun Tang, Wei Hong, Ji Xin Chen, Guo Qing Luo, and Ke Wu, "Development of High-performance Millimeter Wave Diplexers Based on the Complementary Characters of Dual-mode Substrate Integrated Waveguide Filters with Circular and Elliptic Cavities. *IEEE Transactions on Microwave Theory and Techniques*. Vol 55, no. 4 pp. 776-782, April 2007

[11] H. J. Tang, W. Hong, Z. C. Hao, J. X. Chen, K. Wu, "Optimal design of compact millimeter-wave SIW circular cavity filters", *Electronics Letters, vol.* 41, no. 19, pp. 1068-1069, September 2005

[12] Y. Chung, S. Jeon, D. Ahn, J. Choi, and T. Itoh, "High Isolation Dual-Polarized Patch Antenna Using Integrated Defected Ground Structure" *IEEE Microwave And Wireless Components Letters*, VOL. 14, NO. 1, January 2004

The invention claimed is:

1. An antenna configuration for use in a mobile telecommunications device to provide three-dimensional, orthogonal polarisation, said antenna configuration comprising:

a half mode substrate integrated waveguide (HMSIW) antenna comprising two parallel conductive plates separated by a dielectric, said HMSIW antenna having a substantially rectangular shape comprising a first edge, a second edge perpendicular to the first edge and connected to the first edge by a first corner, a third edge opposing and parallel to the first edge and connected to the second edge by a second corner, and a fourth edge opposing and parallel to the second edge and connected to the first edge by a third corner and to the third edge by a fourth corner, wherein the first and second edges are open for radiation;

a first slot antenna including a first dielectric strip extending from the third corner in a direction which is parallel to and collinear with the first edge and away from the first corner; and a second slot antenna including a second dielectric strip extending from the second corner in a direction which is parallel to and collinear with the second edge and away from the first corner;

wherein said two parallel plates of the HMSIW antenna lie in a plane defined by the first and second dielectric strips, and wherein the first slot antenna is responsible for linear polarisation in a direction parallel to the first edge, the second thick-slot antenna is responsible for linear polarisation in a direction parallel to the second edge, and the HMSIW antenna is responsible for linear polarisation in a direction perpendicular to the parallel conductive plates of the HMSIW antenna.

2. The antenna configuration of claim 1 wherein the first slot antenna further comprises a first conductive strip aligned with first dielectric strip, wherein said first conductive strip is shorter than said first dielectric strip to form a first open slot for radiation at one end of the first dielectric strip.

3. The antenna configuration of claim 2, wherein the first slot antenna further comprises a first conductive wall structure parallel to the first conductive strip and separated from the first conductive strip by the first dielectric strip, wherein said first conductive wall structure is connected to the opposite end of the first conductive strip from the first open slot.

4. The antenna configuration of claim 1 wherein the second slot antenna further comprises a second conductive strip aligned with second dielectric strip, wherein said second conductive strip is shorter than said second dielectric strip to form a second open slot for radiation at one end of the second dielectric strip.

5. The antenna configuration of claim 4, wherein the second slot antenna further comprises a second conductive wall structure parallel to the second conductive strip and separated from the second conductive strip by the second dielectric strip, wherein said second conductive wall structure is connected to the opposite end of the second conductive strip from the second open slot.

6. The antenna configuration of claim 5, wherein the first open slot for radiation is adjacent to the third corner of the HMSIW antenna, but separated from said third corner of the HMSIW antenna by a portion of the first conductive wall structure, and wherein the second open slot for radiation is adjacent to the second corner of the HMSIW antenna, but separated from said second corner of the HMSIW antenna by a portion of the second conductive wall structure.

7. The antenna configuration of claim 6, wherein the first conductive wall structure, the second conductive wall structure, and a conductor lining the third and fourth edges of the HMSIW antenna are formed as a single conductor element.

8. The antenna configuration of claim 1, wherein the dielectric of the HMSIW antenna is selected to provide an impedance bandwidth ($20 \log|S_{ii}|<-10$ dB) of 150 MHz or greater.

9. The antenna configuration of claim 8, wherein the thickness and dielectric constant of the dielectric of the HMSIW antenna are approximately 6.4 mm and 2.2 respectively.

10. The antenna configuration of claim 1, wherein the HMSIW antenna has a substantially square shape, whereby the length of the first edge equals the length of the second edge, and is in the range 18-30 mm.

11. The antenna configuration of claim 10, whereby the length of the first edge and the length of the second edge are both approximately 21 mm.

12. The antenna configuration of claim 1, wherein the first slot antenna has a length, measured in a direction parallel to said first dielectric strip, in the range 12-25 mm, and wherein the second slot antenna has a length, measured in a direction parallel to said second dielectric strip, in the range 12-25 mm.

13. The antenna configuration of claim 12, wherein the length of the first slot antenna is approximately 17 mm, and wherein the length of the second slot antenna is approximately 17 mm.

14. The antenna configuration of claim 12, wherein the first slot antenna has a width, measured in a direction parallel to said second dielectric strip, in the range 2.5-4 mm, and wherein the second slot antenna has a width, measured in a direction parallel to said first dielectric strip, in the range 2.5-4 mm.

15. The antenna configuration of claim 1, wherein said first corner of the HMSIW antenna is rounded or bevelled.

16. The antenna configuration of claim 1, wherein the third and fourth edges of the HMSIW antenna are lined by via holes.

17. The antenna configuration of claim 1, wherein the thickness of the antenna configuration, measured in a direction perpendicular to said two parallel plates, is equal to or less than 10% of the operating wavelength in free space.

18. The antenna configuration of claim 1, further comprising a battery pack which forms at least part of the dielectric of the HMSIW antenna.

19. A mobile communication device, comprising:

the mobile communication device;

an antenna configuration within the mobile communication device to provide three-dimensional, orthogonal polarisation, said antenna configuration comprising:

a half mode substrate integrated waveguide (HMSIW) antenna comprising two parallel conductive plates separated by a dielectric, said HMSIW antenna having a substantially rectangular shape comprising a first edge, a second edge perpendicular to the first edge and connected to the first edge by a first corner, a third edge opposing and parallel to the first edge and connected to the second edge by a second corner, and a fourth edge opposing and parallel to the second edge and connected to the first edge by a third corner and to the third edge by a fourth corner, wherein the first and second edges are open for radiation;

a first slot antenna including a first dielectric strip extending from the third corner in a direction which is parallel to and collinear with the first edge and away from the first corner; and a second slot antenna including a second dielectric strip extending from the second corner in a direction which is parallel to and collinear with the second edge and away from the first corner;

wherein said two parallel plates of the HMSIW antenna lie in a plane defined by the first and second dielectric strips, and wherein the first slot antenna is responsible for linear polarisation in a direction parallel to the first edge, the second slot antenna is responsible for linear polarisation in a direction parallel to the second edge, and the HMSIW antenna is responsible for linear polarisation in a direction perpendicular to the parallel conductive plates of the HMSIW antenna.

20. The mobile communication device of claim 19, further comprising a battery pack which forms at least part of the dielectric of the HMSIW antenna, wherein said battery pack is configured to provide power to the mobile communication device.

* * * * *